US005505045A

United States Patent [19]

Lee et al.

[11] Patent Number: 5,505,045

[45] Date of Patent: Apr. 9, 1996

[54] FUEL INJECTOR ASSEMBLY WITH FIRST AND SECOND FUEL INJECTORS AND INNER, OUTER, AND INTERMEDIATE AIR DISCHARGE CHAMBERS

[75] Inventors: Fei P. Lee, Novi; Mike Guzowski, Canton, both of Mich.

[73] Assignee: Fuel Systems Textron, Inc., Zeeland, Mich.

[21] Appl. No.: 288,655

[22] Filed: Aug. 10, 1994

Related U.S. Application Data

[63] Continuation of Ser. No. 973,377, Nov. 9, 1992, abandoned.

[51] Int. Cl.[6] ..... F02C 1/00; B05B 7/06

[52] U.S. Cl. ..... 60/748; 60/737; 60/740; 60/742; 239/424

[58] Field of Search ..... 60/740

[56] References Cited

U.S. PATENT DOCUMENTS

| | | | |
|---|---|---|---|
| 783,898 | 2/1905 | Scherding . | |
| 2,107,998 | 2/1938 | Rullison . | |
| 2,574,865 | 11/1951 | Edwards . | |
| 2,893,647 | 7/1959 | Wortman . | |
| 3,310,240 | 3/1967 | Grundman . | |
| 3,468,487 | 9/1969 | Warren | 239/424 |
| 3,483,700 | 12/1969 | Ryberg et al. . | |
| 3,598,321 | 8/1971 | Bobzin . | |
| 3,684,186 | 8/1972 | Helmrich . | |
| 3,915,387 | 10/1975 | Caruel et al. | 60/748 |
| 3,937,011 | 2/1976 | Caruel et al. . | |
| 3,980,233 | 9/1976 | Simmons et al. . | |
| 4,260,367 | 4/1981 | Markowski et al. | 60/742 |
| 4,290,558 | 9/1981 | Coburn et al. . | |
| 4,327,547 | 5/1982 | Hughes et al. . | |
| 4,337,618 | 7/1982 | Hughes et al. . | |
| 4,342,198 | 8/1982 | Willis . | |
| 4,425,755 | 1/1984 | Hughs | 60/742 |
| 4,470,262 | 9/1984 | Shekleton | 60/748 |
| 4,600,151 | 7/1986 | Bradley . | |
| 4,698,963 | 10/1987 | Taylor . | |
| 4,726,192 | 2/1988 | Willis et al. . | |
| 4,854,127 | 8/1987 | Vinson et al. . | |
| 4,977,740 | 12/1990 | Madden et al. | 60/742 |
| 5,014,918 | 5/1991 | Halvorsen | 60/740 |
| 5,102,054 | 4/1992 | Halvorsen | 60/742 |
| 5,243,816 | 9/1993 | Huddas | 60/740 |
| 5,256,352 | 10/1993 | Snyder et al. | 239/424.5 |

FOREIGN PATENT DOCUMENTS

| | | | |
|---|---|---|---|
| 1775973 | 5/1973 | Germany . | |
| 0127604 | 3/1950 | Sweden | 239/416.4 |
| 559730 | 8/1977 | U.S.S.R. . | |
| 2091409 | 7/1982 | United Kingdom | 60/742 |

*Primary Examiner*—Richard A. Berisch
*Assistant Examiner*—Ted Kim
*Attorney, Agent, or Firm*—Edward J. Timmer

[57] ABSTRACT

An improved airblast fuel injector for a gas turbine engine wherein the injector comprises an inner air discharge chamber, a first fuel discharge chamber disposed outboard of the inner air chamber, an intermediate air discharge chamber disposed radially outboard of the first fuel chamber, a second fuel discharge chamber disposed radially outboard of the first outer air chamber, and an outer air discharge chamber disposed radially outboard of the second fuel chamber. The fuel flow from the first fuel discharge chamber is subjected to inner and outer atomizing air flows from the inner and intermediate air chambers. The fuel flow from the second fuel discharge chamber is subjected to inner and outer atomizing airflows from the intermediate and outer air discharge chambers. The individual fuel flow streams discharged from the first and second fuel discharge chambers provide an aggregate, high mass flow of fuel necessary for engine operation. The individual, atomized fuel flow streams discharged from the injector face are blended together downstream of the discharge face.

13 Claims, 1 Drawing Sheet

FUEL INJECTOR ASSEMBLY WITH FIRST AND SECOND FUEL INJECTORS AND INNER, OUTER, AND INTERMEDIATE AIR DISCHARGE CHAMBERS

This application is a continuation of U.S. Ser. No. 07/973,377, filed Nov. 9, 1992 now abandoned.

FIELD OF THE INVENTION

The present invention relates to an airblast fuel injector for use in a gas turbine engine.

BACKGROUND OF THE INVENTION

Fuel injectors have been developed for gas turbine engines to reduce combustion emissions, such as smoke and nitrogen oxide emissions. For example, the Coburn U.S. Pat. No. 4 290 558 issued Sep. 27, 1981 describes gas turbine fuel nozzle capable of operating in a fuel/water injection mode for smoke reduction purposes.

The Bradley U.S. Pat. No. 4 600 151 issued Jul. 15, 1986 describes an airblast fuel injector capable of operating in dual fuel, alternate fuel, or fuel/water modes for thrust augmentation and emissions reduction purposes. Airblast fuel injectors are designed to achieve atomization of a film of liquid fuel formed on a fuel discharge orifice surface by directing high velocity airflow supplied to the injector from the engine compressor at the fuel film as it leaves the orifice surface. Typically, the atomizing airflow is directed at both sides of the fuel film leaving the orifice surface. Such airblast fuel injectors are described further in the Helmrich U.S. Pat. No. 3 684 186 issued Aug. 15, 1972 and the Simmons et al U.S. Pat. No. 3 980 233 issued Sep. 14, 1976.

With the development of lower emission gas turbine engines, there is an increased requirement for fuel injectors that can provide more uniform fuel dispersion and higher rate of fuel/air mixing in the combustor environment. This situation adversely affects the qualification of current airblast injectors for low-emission gas turbine applications. Current airblast injectors are susceptible to higher levels of combustion emissions due to their limited capability in fuel dispersion and fuel/air mixing and therefore are less satisfactory for low-emission applications. In view of the desire in the gas turbine industry for lower emission engines, there is a need to provide airblast injectors capable of satisfactorily atomizing and distributing the fuel flow to reduce the emission level from the gas turbine engine.

The present invention has an object to satisfy this need by providing an improved airblast fuel injector capable of reducing combustion emissions from the engine via enhanced fuel atomization and distribution as well as fuel/air mixing.

SUMMARY OF THE INVENTION

The present invention contemplates an improved airblast fuel injector for a gas turbine engine wherein the fuel injector comprises an inner air discharge chamber, a first fuel discharge chamber disposed outboard of the inner air chamber in a direction transverse to a longitudinal axis of the injector and converging toward the axis, an intermediate air discharge chamber disposed outboard of the first fuel chamber in the transverse direction and converging toward the axis, a second fuel discharge chamber disposed outboard of the first outer air chamber in the transverse direction and converging toward the axis, and an outer air discharge chamber disposed outboard of the second fuel chamber in the transverse direction and converging toward the axis.

The individual fuel flow streams through the first and second fuel discharge chambers can provide an aggregate, high mass flow of fuel necessary for engine operation in all regimes (i.e. the fuel flows through the first and second chambers are provided under all engine operation regimes). The fuel flow from the first fuel discharge chamber is subjected to inner and outer atomizing air flows from the inner and intermediate air discharge chambers. The fuel flow from the second fuel discharge chamber is subjected to inner and outer atomizing airflows from the intermediate and outer air discharge chambers. The individual, atomized fuel flow streams from the injector are merged or blended together downstream of the discharge face of the injector as determined by the convergence and axial (longitudinal)/radial (transverse) orientation of the fuel and air discharge chambers as well as by air and fuel swirl angles.

In one embodiment of the invention, the inner air discharge chamber, the first fuel discharge chamber, the intermediate air discharge chamber, the second fuel discharge chamber, and the outer air discharge chamber converge toward the longitudinal axis at respective acute angles that increase from one chamber to the next. Preferably, the inner air discharge chamber converges up to about 20°, the first fuel discharge chamber converges at an acute angle of about 20° to about 35°, the intermediate air discharge chamber converges at an acute angle of about 30° to about 45°, the second fuel discharge chamber converges at an acute angle of about 40° to about 55°, and the outer air discharge chamber converges at an acute angle of about 50° to about 60°.

In another embodiment of the invention, the first and second fuel discharge chambers include respective fuel discharge ends spaced longitudinally (axially) by a distance "x" and transversely (radially) by a distance "R" such that a ratio of x/R equals 0 to about 2.0. This relationship x/R is selected in this range so that the fuel discharged from the second fuel discharge end is radially separated from the fuel discharged from the first fuel end, allowing each individual fuel discharge to be fully atomized before the atomized fuel streams are merged in the combustor at a location downstream of the fuel injector discharge face.

The aforementioned objects and advantages of the present invention will become more readily apparent from the detailed description and drawings which follow.

DESCRIPTION OF THE DRAWING

The FIGURE is a longitudinal sectional view of one embodiment of an airblast injector of the invention.

DETAILED DESCRIPTION OF THE INVENTION

Figure 1:
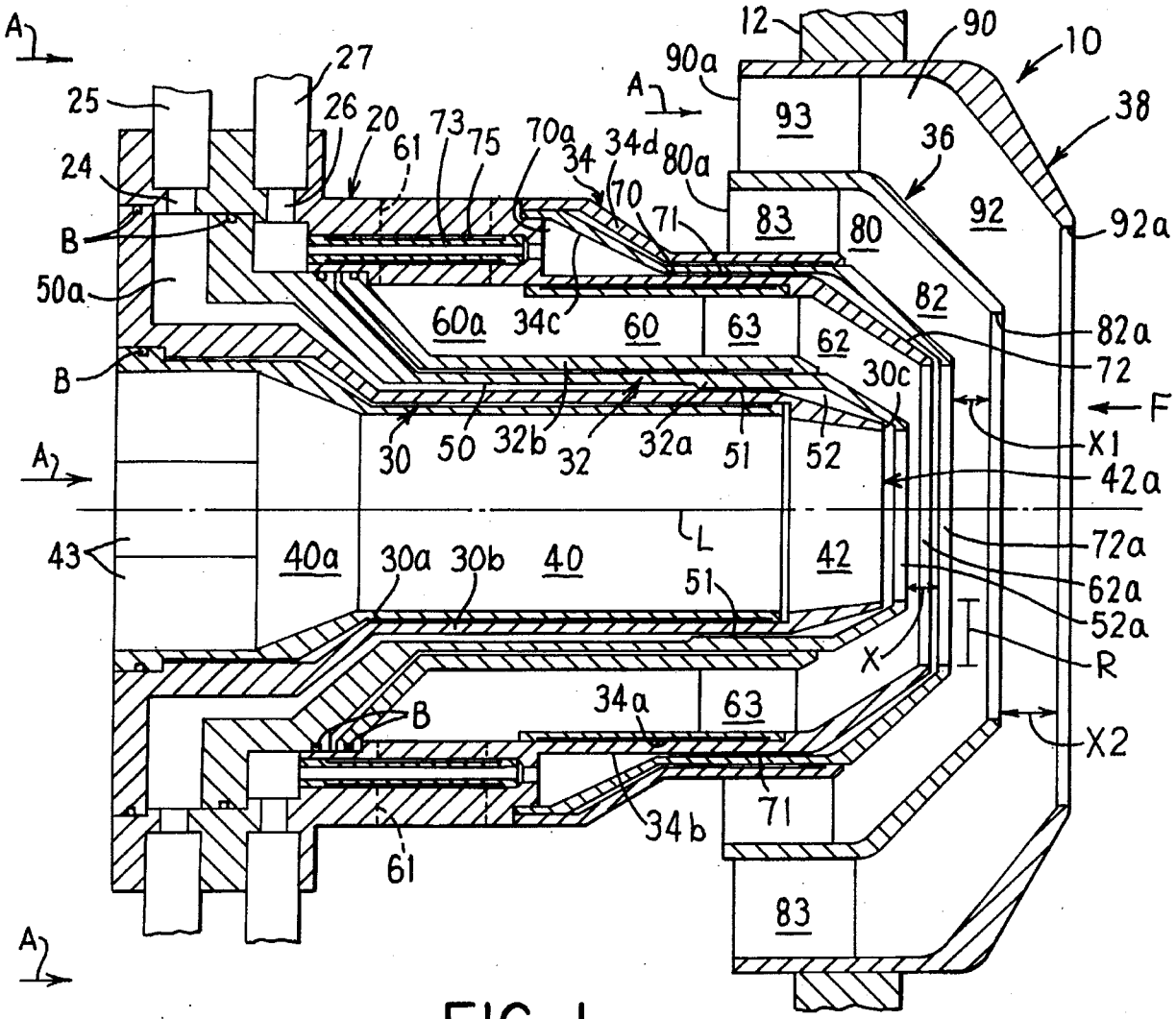

Referring to the FIGURE, an improved airblast fuel injector 10 in accordance with one embodiment of the invention is shown. The fuel injector 10 is mounted in an opening in a gas turbine engine combustor wall 12 (partially shown) in conventional manner. The fuel injector uses compressor discharge air (see arrows A) for fuel atomization as is known in the art; e.g., see U.S. Pat. No. 3 684 186.

The fuel injector 10 is shown including a tubular support body 20 having first and second liquid fuel supply passages 24, 26 communicating with first and second fuel supply conduits 25, 27. The conduits 25, 27 extend from respective fuel manifold and pump assemblies (not shown) for supplying pressurized fuel flow to each passage 24, 26.

A plurality of tubular body assemblies 30, 32, 34 are brazed, welded or otherwise metallurgically fastened to the support body 20 as shown in the FIGURE. The inner tubular body assembly 30 includes first and second tubes 30*a*, 30*b* fastened (e.g. brazed) together as shown at B (reference letter B designates braze throughout the drawing) to define an insulating air space therebetween. The inner tubular body assembly 30 defines a cylindrical, inner air supply chamber 40 having an upstream open end 40*a* for receiving the compressor discharge air via a plurality of circumferentially spaced air swirler vanes 43 and communicating with a frusto-conical inner air discharge chamber 42. The discharge chamber 42 preferably is frusto-conical in configuration so as to converge toward the longitudinal axis L of the injector at an angle of about 5°. However, the invention is not so limited since the inner air discharge chamber 42 may be oriented at an angle from 0° to about 20° relative to the axis L in practicing the invention.

The inner air discharge chamber 42 includes an annular, downstream inner air discharge end or lip 42*a* for discharging inner air flow for fuel atomization purposes. The inner air discharge end 42*a* is defined by an annular end surface 30*c* of the tube 30*b* of the inner tubular body assembly 30 as shown. The inner and outer diameter of the annular end surface 30*c* are about 0.55 inch and 0.58 inch, respectively.

The intermediate tubular body assembly 32 is disposed outboard of the inner tubular body assembly 30 in a radial direction (transverse to axis L) and includes first and second tubes 32*a*, 32*b* fastened (e.g. brazed) to the support tube 20 as shown at B to define an insulating air space therebetween. The intermediate tubular body assembly 32 defines a first, annular, inner fuel supply chamber 50 having an annular upstream open end 50*a* for receiving the fuel from passage 24 and communicating with a frusto-conical fuel discharge chamber 52. A plurality of circumferentially spaced apart fuel swirler vanes 51 are disposed in the fuel supply chamber 50 to impart swirl to the fuel. The discharge chamber 52 preferably converges toward the longitudinal axis L of the injector at an acute angle of about 25°, more generally between about 20° to about 35°. The inner fuel discharge chamber 50 includes an annular, downstream fuel discharge end or lip 52*a* for discharging a first fuel flow or stream as a film or thin layer amenable for atomization. The discharge end 52*a* is defined by an axially extending, cylindrical surface on the tube 32*a* of the intermediate tubular assembly 32 as shown. The diameter and axial dimension of the discharge end 52*a* are about 0.55 and about 0.02 inch, respectively.

The discharge ends 42*a*, 52*a* are located axially proximate one another as shown in the FIGURE so that the film thickness of discharging liquid fuel can be controlled. For example, the axial space between the discharge ends 42*a*, 52*a* is about 0.04 inch.

The outer tubular body assembly 34 is disposed outboard of the intermediate tubular body assembly 32 in a transverse (radial) direction and includes first and second tubes 34*a*, 34*b* fastened together to define an insulating air space therebetween. The tube 34*b* is integral with the support body 20. The outer tubular body assembly 34 defines an annular intermediate air supply chamber 60 having an upstream open end 60*a* for receiving the compressor discharge air via a plurality of circumferentially spaced apart, radially extending air entrances 61 formed in the support body 20 and a plurality of circumferentially spaced apart air swirler vanes 63. The air supply chamber 60 communicates with a frusto-conical outer air discharge chamber 62. The discharge chamber 62 preferably converges toward the longitudinal axis L of the injector at an acute angle of about 35°, more generally between about 30° to about 45°.

The intermediate air discharge chamber 62 includes an annular, downstream air discharge end or lip 62*a* for discharging air flow for fuel atomization purposes. The intermediate air discharge end 62*a* is defined by an axially extending, cylindrical surface of the tube 34*b* of the outer tubular assembly 34 as shown. The diameter and axial dimension of the cylindrical surface are about 1.00 and 0.02 inch, respectively.

The outer tubular body assembly 34 also includes third and fourth tubes 34*c*, 34*d* fastened together to define an insulating air space therebetween. The outer tubular body assembly 34 thereby defines a second, annular, outer fuel supply chamber 70 having an upstream end 70*a* for receiving fuel via an axially extending fuel supply tube 73 communicating with the passage 26. The fuel supply tube 73 is fastened (e.g., brazed) in a bore 75 in the support body in a manner to form an insulating air space therebetween. The fuel supply chamber 70 includes a plurality of circumferentially spaced apart fuel swirler vanes 71 to impart swirl to the fuel and communicates with a frusto-conical second fuel discharge chamber 72. The discharge chamber 72 preferably converges toward the longitudinal axis L of the injector at an acute angle of about 42°, more generally between about 40° to about 55°.

The second fuel discharge chamber 72 includes a downstream outer fuel discharge end or lip 72*a* for discharging a second fuel flow or stream as a film or thin layer amenable for atomization. The second fuel discharge end 72*a* is defined by an axially extending, cylindrical surface of the tube 34*c* of the outer tubular assembly 34 as shown. The cylindrical surface of the discharge end 72*a* has the same diameter and axial dimension as the proximate cylindrical surface of air discharge end 62*a*.

The discharge ends 62*a*, 72*a* are located axially proximate one another as shown in the FIGURE so that the film thickness of discharging liquid fuel can be controlled. For example, the axial space between the discharge ends 62*a*, 72*a* is about 0.025 inch.

Moreover, the first and second fuel discharge ends 52*a*, 72*a* are longitudinally and transversely spaced by a distance "x" (e.g., 0.16 inch) and "R" (e.g., 0.45 inch), respectively, such that a ratio of x/R equals 0.710, more generally from 0 to about 2.0. This relationship x/R is maintained at such a small value so that the second fuel discharge is radially separated from the first fuel discharge. This allows each fuel discharge to be completely atomized individually before the two atomized streams merge in the combustor at a downstream location from the injector face F.

Tubular bodies 36 and 38 are mounted (e.g. brazed) on the outer tubular body assembly 34 outboard of the outer tubular body assembly 36 in a transverse (radial) direction. Alternatively, tubular bodies 36,38 can be fastened on the combustor wall 12. Or, tubular body 36 can be fastened on the tubular assembly 34 while tubular body 38 is fastened on the combustor wall 12.

Tubular body 36 defines an annular outer air supply chamber 80 having an upstream open end 80*a* for receiving the compressor discharge air via a plurality of circumferentially spaced apart air swirler vanes 83 and communicating with a frusto-conical outer air discharge chamber 82. The discharge chamber 82 preferably converges toward the longitudinal axis L of the injector at an acute angle of about 55°, more generally between about 50° to about 60°.

The outer air discharge chamber 82 includes an annular, downstream outer air discharge end or lip 82*a* for discharging outer air flow for fuel atomization purposes. The outer air discharge end 82 is defined by an axially extending, cylindrical surface 82*a* of the tube 36. The cylindrical surface has a diameter and axial dimension of about 1.40 inch and about 0.030 inch, respectively. The lip 82*a* is spaced axially downstream from fuel discharge lip by distance X1 (e.g., 0.18 inch).

Tubular body 38 defines a second, annular outer air supply chamber 90 having an upstream open end 90*a* for receiving the compressor discharge air via a plurality of circumferentially spaced apart air swirler vanes 93 and communicating with a frusto-conical outer air discharge chamber 92. The discharge chamber 92 preferably converges toward the longitudinal axis L of the injector at an acute angle of about 60°, more generally between about 55° to about 75°.

The second outer air discharge chamber 92 includes an annular, downstream outer air discharge end or lip 92*a* for discharging outer air flow for the purpose of additional fuel atomization and the refinement of final shapes of the two atomized fuel streams. The outer air discharge end 92 is defined by an axially extending, cylindrical surface 92*a* of the tube 38. The cylindrical surface has a diameter and axial dimension of about 2.0 inch and about 0.030 inch, respectively. The lip 92*a* is spaced axially downstream from air discharge lip 82*a* by distance X2 (e.g., 0.26 inch).

The support body 20 and tubes 30, 32, 34, 36, 38 (as well as their discharge ends 42*a*, 52*a*, 62*a*, 72*a*, 82*a*, 92*a*) are concentrically disposed relative to the longitudinal axis L. The support body 20 and tubes 30, 32, 34, 36, 38 comprise injector body means for defining the air and fuel discharge chambers described hereinabove.

The individual fuel flow streams through the first and second fuel discharge chambers 52, 72 provide an aggregate fuel flow necessary for engine operation in all regimes (i.e. the fuel flows through the first and second chambers 52, 72 are provided under all engine operation regimes). The fuel flow from the first fuel discharge chamber 52 (and thus discharge end 52*a*) is subjected to inner and outer atomizing air flows from the inner air chamber 42 and the intermediate air chamber 62 (and thus discharge ends 42*a*, 62*a*). The fuel flow from the second fuel discharge chamber 72 (and thus discharge end 72*a*) is subjected to inner and outer atomizing air flows from the intermediate and outer air discharge chambers 62, 82 (and thus discharge ends 62*a*, 92*a*). The air flow from the second outer air discharge chamber 92 (and thus discharge end 92*a*) is directed to provide additional atomization air to the two fuel streams and to refine the shapes of the two atomized streams axially downstream of the injector discharge face F.

Thus, each fuel flow stream discharged at ends 52*a*, 72*a* is subjected to both inner and outer air atomizing flows.

The individual, atomized fuel flow streams are discharged from the injector discharge face F and atomized as substantially radially separate fuel streams that are subsequently merged or blended together in the combustor downstream of the discharge face F of the injector as determined by the convergence and axial (longitudinal)/radial (transverse) orientation of the discharge chambers 42, 52, 62, 72, 82, 92 as well as by air swirl angles of the inner, intermediate, and outer air flows (air from discharge ends 42*a*, 62*a*, 82*a*, 92*a* as imparted by injector air swirler vanes 43, 63, 83, 93) and fuel swirl angles of the first and second fuel flows (discharged from fuel discharge ends 52*a*, 72*a* as imparted by fuel swirler vanes 51, 71).

The swirl angle of air swirler vanes 43 is about 30° to about 70°, preferably 60°, while swirl angle of air swirler vanes 63 is about 40°, to about 70°, preferably 60°. The swirl angle of air swirlers vanes 83, 93 is the same; namely, about 30° to about 70°, preferably about 60°.

The swirl angle of fuel swirler vanes 51 is about 30° to about 70°, preferably about 50°. The swirl angle of fuel swirler vanes 71 is about 30° to about 70°, preferably about 60°.

As set forth hereinabove, the inner air discharge chamber 42, the first fuel discharge chamber 52, the intermediate air discharge chamber 62, the second fuel discharge chamber 72, and the outer air discharge chamber 82 converge toward the longitudinal axis L at respective acute angles that increase from one chamber to the next along the axis L to this end. Preferably, the inner air discharge chamber converges at about 5°, the first fuel discharge chamber converges at an acute angle of about 25°, the intermediate air discharge chamber converges at an acute angle of about 35°, the second fuel discharge chamber converges at an acute angle of about 42°, and the outer air discharge chamber converges at an acute angle of about 55°. However, as mentioned hereinabove, the present invention may be practiced using angles selected from the more general ranges set forth.

Moreover, the first and second fuel discharge ends 52*a*, 72*a* are longitudinally spaced by the distance "x" and "R", respectively, such that a ratio of x/R preferably equals 0.710, although x/R may be selected from 0 to about 2.0 as also mentioned hereinabove.

The fuel flows discharged from chambers 52, 72 aggregate to provide a high fuel mass flow as proposed for the new low emission gas turbine engines and yet are adequately atomized and distributed using the highly dense (highly pressurized) atomizing air received from the compressor and discharged from air discharge chambers 42, 62, 82, 92. As a result, the airblast injector in accordance with the invention can properly atomize and distribute the fuel and reduce combustion emissions from the engine.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A fuel injector for a gas turbine engine, comprising an injector body means having a longitudinal axis and defining an inner air discharge chamber with an inner air discharge end, a first fuel discharge chamber disposed outboard of the inner air discharge chamber in a direction transverse to said axis and converging at an acute angle toward said axis and terminating in a first fuel discharge end downstream of said inner air discharge end, an intermediate air discharge chamber disposed outboard of the first fuel discharge chamber in said transverse direction and converging at an acute angle toward said axis and terminating in an intermediate air discharge end, a second fuel discharge chamber disposed outboard of the intermediate air discharge chamber in said transverse direction and converging at an acute angle toward said axis and terminating in a second fuel discharge end, and an outer air discharge chamber disposed outboard of the second fuel discharge chamber in said transverse direction and converging at an acute angle toward said axis and terminating in an outer air discharge end, wherein fuel discharged from said first fuel discharge and provides a first fuel stream that is subjected to atomizing air flows from said inner air discharge end and said intermediate air discharge end and fuel discharged from said second fuel discharge end provides a radially separate second fuel stream that is subjected to atomizing air flows from said intermediate air discharge end and said outer air discharge end, and first and second liquid fuel supply conduits for providing first and second fuel flow to the respective first and second fuel discharge chambers during all regimes of engine operation such that the first and second fuel flow together provide an aggregate fuel flow necessary for engine operation.

2. The fuel injector of claim 1 wherein said first fuel discharge chamber, said intermediate air discharge chamber, said second fuel discharge chamber, and said outer air discharge chamber converge toward said axis at respective acute angles that increase from one chamber to the next in a direction from said inner air chamber toward said outer air discharge chamber.

3. The fuel injector of claim 2 wherein said first fuel discharge chamber converges at an acute angle of about 20° to 35°, said intermediate air discharge chamber converges at an acute angle of about 30° to 45°, said second fuel discharge chamber converges at an acute angle of about 40° to 55°, and said outer air discharge chamber converges at an acute angle of about 50° to 60°.

4. The fuel injector of claim 2 wherein said inner air discharge chamber converges toward said axis at an acute less than said first fuel discharge chamber.

5. The fuel injector of claim 4 wherein said inner air discharge chamber converges at an acute angle up to about 5°.

6. The fuel injector of claim 1 wherein said inner air discharge chamber includes an inner annular air discharge end concentric with said axis, said first fuel discharge chamber includes a fuel discharge end concentric with said axis, said intermediate air discharge chamber includes an air discharge end concentric with said axis, said second fuel discharge chamber includes a second fuel discharge end concentric with said axis, and said outer air chamber includes an outer air discharge end concentric with said axis.

7. The fuel injector of claim 6 wherein said first fuel discharge end and said second fuel discharge end are oriented relative to one another such that the fuel discharged from said first fuel discharge end is radially separated from fuel discharged from said second fuel discharge end.

8. The fuel injector of claim 7 wherein said first fuel discharge end and said second fuel discharge end are spaced at least one of longitudinally and transversely by a distance "x" and "R", respectively, such that a ratio of x/R equals 0 to 2.0.

9. The fuel injector of claim 1 wherein said first fuel discharge chamber, said intermediate air discharge chamber, said second fuel discharge chamber, and said outer air discharge chamber are frusto-conical in configuration.

10. The fuel injector of claim 1 further including a second outer air discharge chamber disposed outboard of said outer air discharge chamber in said transverse direction and converging toward said axis.

11. The fuel injector of claim 1 further including axially oriented air swirl vanes upstream each of said inner air discharge chamber, said intermediate air discharge chamber, and said outer air discharge chamber for imparting an air swirl angle thereto.

12. The fuel injector of claim 11 wherein the air swirl angles are about 30° to 70° for the inner air flow, about 40° to 70° for the intermediate air flow, and about 40° to 70° for the outer air flow.

13. The fuel injector of claim 1 or 11 further including fuel swirl means for imparting a fuel swirl wherein fuel swirl vane angles of about 30° to 70° are provided for fuel swirl vanes of the first fuel chamber and fuel swirl vane angles of about 30+ to 70° provided for fuel swirl vanes of the second fuel chamber.

* * * * *